US005690257A

United States Patent [19]

Ward

[11] Patent Number: 5,690,257

[45] Date of Patent: Nov. 25, 1997

[54] FOLDING HANGER FOR GARMENTS AND THE LIKE

[76] Inventor: Jim Ward, P.O. Box 1702, Hayden, Id. 83835-1702

[21] Appl. No.: 766,485

[22] Filed: Dec. 13, 1996

[51] Int. Cl.[6] ..... A47G 25/40

[52] U.S. Cl. ..... 223/94; 223/89

[58] Field of Search ..... 223/89, 94, 85, 223/88, 92

[56] References Cited

U.S. PATENT DOCUMENTS

| | | | |
|---|---|---|---|
| 2,745,579 | 5/1956 | Goodman | 223/94 |
| 3,040,941 | 6/1962 | Vargo | 223/89 |
| 3,531,028 | 9/1970 | Vazquez | 223/94 |
| 4,673,115 | 6/1987 | LaMont | 223/94 |
| 4,988,021 | 1/1991 | Adams et al. | 223/89 |
| 5,383,584 | 1/1995 | Adams | 223/94 |

*Primary Examiner*—Bibhu Mohanty
*Attorney, Agent, or Firm*—Tom Hamill, Jr.

[57] ABSTRACT

A folding hanger to be employed in the hanging of garments and the like is provided. The hanger includes a first wing portion and a second wing portion which fold about a central pivot. The central pivot may be a living hinge or a pin element which rotates in a bearing. The hanger has a simple folded and unfolded configuration. Latching means are provided for the hanger when in the unfolded configuration. The latching means includes a simple flexible tongue element which is received in a socket. The flexible tongue element includes a protrusion proximal the tip which will be positively retained in the socket. By depressing the flexible tongue the protrusion will be brought out of retention in the socket permitting the hanger to be folded about the central pivot. A J-shaped hook depends from one of the wings which permits the hanger to be hung in a conventional fashion. The hanger may be manufactured as a integral unit through a molding process and may be comprised of one of any of a variety of plastics or the like. Other embodiments of the hanger may be provided as well, including one comprised of wire.

15 Claims, 4 Drawing Sheets

FOLDING HANGER FOR GARMENTS AND THE LIKE

BACKGROUND OF THE INVENTION

1. Field of the Invention

The present invention relates generally to foldable hangers and particularly to hangers comprised of molded plastic or wire and incorporating pivotable wings and locking latches.

2. Background of the Invention

It is often desirable to hang garments with a neck-hole, such as shirts, sweaters and other garments. Non-foldable hangers do not work well as they may stretch, deform, and possibly damage the garment. Folding hangers would permit one to hang such garments without the associated disadvantages of non-foldable hangers. Folding hangers have been taught in the hanger art. They are often complex devices, and although elegant in engineering design, may not be easily used by the consumer or manufactured in a cost effective manner. One such device is the Adams folding hanger, U.S. Pat. No. 5,383,584. This hanger provides a complex latching mechanism as well as many flexible connections between adjacent components. The many interconnected pads, and complicated latching mechanism suggests a greater risk of product failure than would be expected in a simpler design. Further, such a folding hanger would require a relatively complex forming mold, with many spaced, adjacent surfaces and interconnecting cavities so that the mold would be expensive to make, maintain and use. The folding hanger should be simple and consumer friendly as well as be commercially manufacturable in a cost efficient manner. Prior art folding hangers are complex systems which are difficult to use and expensive to manufacture.

Thus, while complex folding hangers have been proposed, the provision of a more simple and cost effective device is not contemplated. Nor does the folding hangers described above teach or suggest a simple latch device which may be engaged or disengaged in an user friendly manner. The disadvantages of the prior art are overcome by the simple construction of the present invention as will be made apparent from the following description thereof. Other advantages of the present invention over the prior art also will be rendered evident.

SUMMARY OF THE INVENTION

To achieve the foregoing and other advantages, the present invention, briefly described, provides a folding hanger to be employed in the hanging of garments and the like. The hanger includes a first wing portion and a second wing portion which fold about a central pivot which also connects the first wing portion to the second wing portion. The central pivot may be a living hinge or a pin element which rotates in a bearing. Other pivoting connection means may be provided. The hanger has a simple folded and unfolded configuration. Latching means are provided for the hanger when in the unfolded configuration. The latching means includes a simple flexible tongue element which is received in a socket. The flexible tongue element includes a protrusion proximal the tip which will be positively retained in the socket. By depressing the flexible tongue the protrusion will be brought out of retention in the socket permitting the hanger to be folded or rotated about the central pivot. Finger holes are provided to receive the digits of the human hand which permit positive control of the hanger when being employed. A J-shaped hook may depend from one of the wings which permits the hanger to be hung in a conventional fashion. Other embodiments are possible, such as the style employed on security hangers used in hotels, which are permanently retained on the rod. The hanger may be manufactured as a integral unit through a molding process and may be comprised of one of any of a variety of plastics or the like. Other embodiments of the hanger may be provided as well, including one comprised of wire.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least the two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present-invention.

It is an object of the present invention to provide an improved folding hanger which includes a simple latching arrangement, which will permit the hanger to be easily placed in its unfolded, latched configuration, as well as its folded, unlatched configuration.

It is a further objective of the present invention to provide an improved folding hanger which is of durable and reliable construction.

An even further object of the present invention is to provide an improved folding hanger which is susceptible of a low cost of manufacture with regard to both materials and labor, and which accordingly is then susceptible of low prices of sale to the consuming public, thereby making such a folding hanger available to the buying public.

It is therefore an object of the present invention to provide an improved folding hanger which has all of the advantages of the prior art and none of the disadvantages.

It is another object of the present invention to provide an improved folding hanger which may be easily and efficiently manufactured and marketed.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved folding hanger embodying the principles and concepts of the present invention will be described.

Figures 1, 1A:
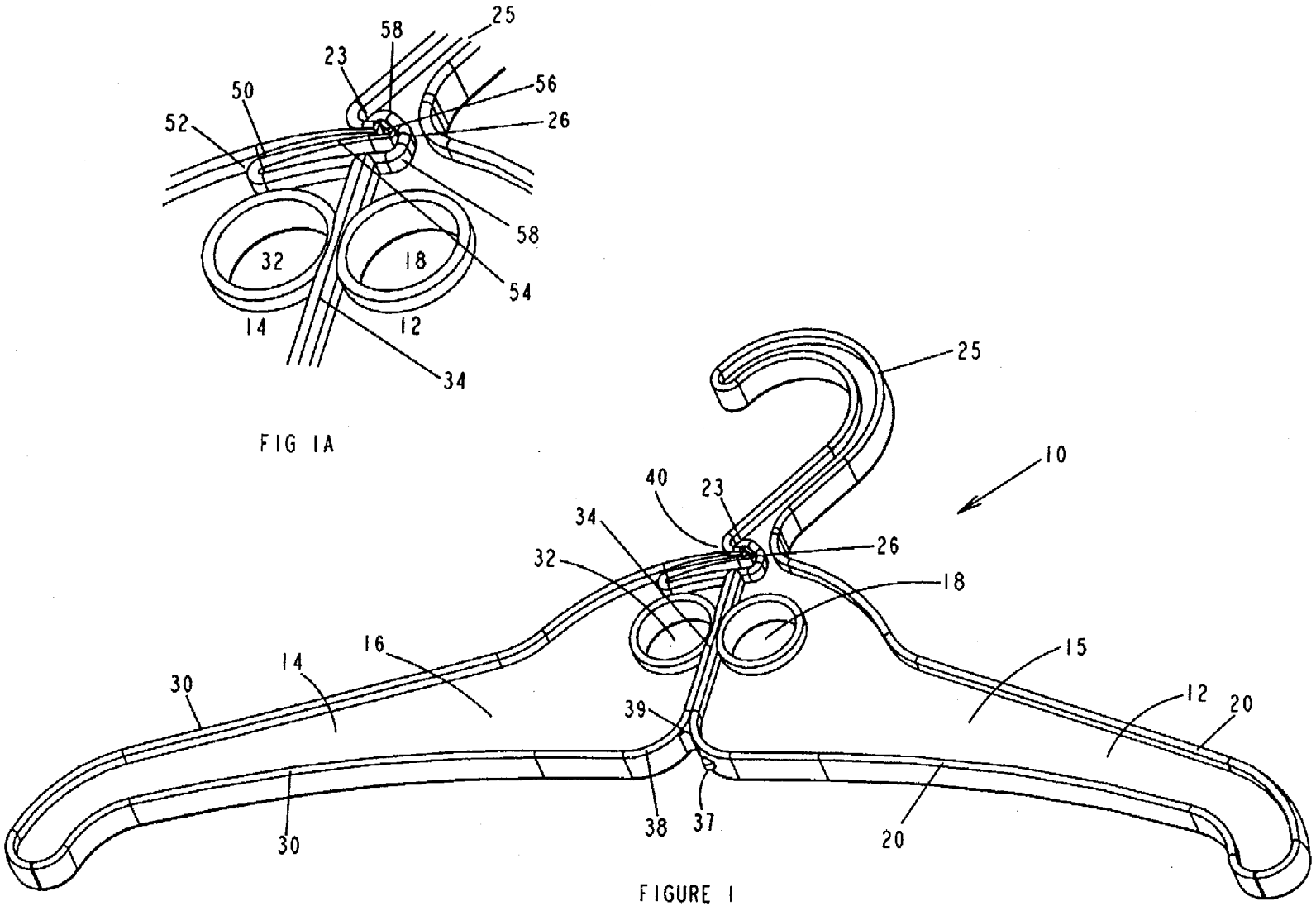
FIG. 1 is a side elevational view of the first embodiment of the foldable hanger of the instant invention in its unfolded, latched configuration.
FIG. 1A is a close-up view of the hanger latching means of the first embodiment of the invention in its folded, latched configuration.
Figure 2:
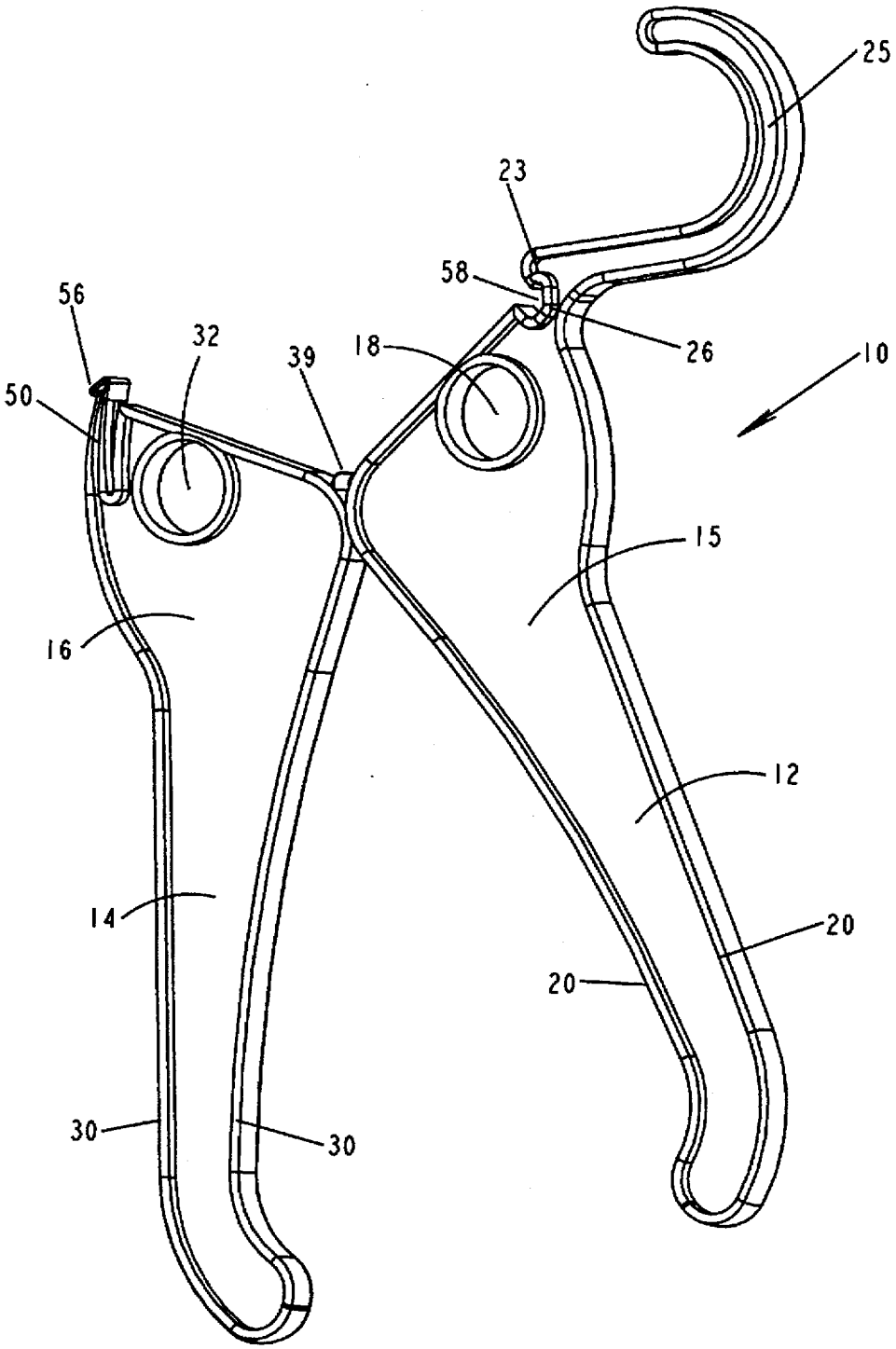
FIG. 2 is a side elevational view of the first embodiment of the foldable hanger of the instant invention in its folded, unlatched configuration.

Turning initially to FIGS. 1 & 2, the first embodiment of the folding hanger 10 is shown. The folding hanger 10 is comprised of molded plastic and is of unitary construction.

The folding hanger 10 includes a first wing 12 and a second wing 14 which may be placed in a fully open position (unfolded) as shown in FIG. 1 and a folded position as shown in FIG. 2. The first wing 12 and the second wing 14 are symmetric to one another and are substantially the same size. A hook 25 is provided for engagement over a closet bar or the like. The hook 25 is integral with the first wing 12 and is connected thereto by neck 26. An complete enclosure may be provided in the embodiment which is permanently affixed to the hanger bar.

The first wing 12 has a perimeter strip 20 which forms an outer boundary about the first wing 12. The region interior of the perimeter strip 20 is generally filled with longitudinally disposed plastic material 15. A first wing finger opening 18 is provided.

The second wing 14 has a perimeter strip 30 which forms an outer boundary about the second wing 14. The region interior of the perimeter strip 30 is generally filled with a longitudinally disposed plastic material 16. A second wing finger opening 32 is provided.

The first wing finger opening 18 and the second wing finger opening 32 are provided to receive the digits of the human hand during the folding and unfolding of the hanger 10. This permits the user to easily actuate the latch mechanism while retaining positive control of the hanger. The finger openings 18, 32 provide a superior facility for grasping, holding and operating the hanger 10. These finger openings prevent the inadvertent slippage of the hanger, especially during the folding and unfolding operations.

The vertical separation 34 is a small separation between the first wing 12 and the second wing 14 when the hanger is in the unfolded position as shown in FIG. 1. In the folded position the first wing 12 is substantially flush with the second wing 14. The vertical separation 34 has a lower portion 38 and an upper portion 40. Proximal lower portion 38 is a connection means 39. Connection means 39 connects the first wing 12 to the second wing 14 in such a fashion to permit the articulation or pivoting of the first wing 12 and the second wing 14 from an unfolded position as shown in FIG. 1 and a folded position as shown in FIG. 2. The connection means 39 will permit the first wing 12 to pivot with respect to the second wing 14 and visa versa through an extended lifetime without failure due to fatigue. A protruding element 37 is provided on the first wing 12 as shown. This protruding element 37 will abut the second wing 14 when in its maximum unfolded position, preventing possibly damaging over folding.

The upper portion 40 includes the latching means. Referring now specifically to FIG. 1A, a close-up view of the latching means is shown. First wing 12 is shown being latched to second wing 14 by tongue 50. Tongue 50 includes a first end 52 and a second end 54. A protrusion 56 depends from the second end 54. A receiving socket 58 is shown, described by the lower end 23 of the hook 25, the neck 26 and the first wing 12. The socket 58 receives the second end 54 and the protrusion 56 within. When the tongue 50 is so received in the socket 58, the first wing 12 and the second wing 14 are positively secured in the unfolded relationship as shown in FIG. 1.

When tongue 50 is pushed in a downward manner, it acts as a cantilevered beam with the fixed end being the first end 52. This will cause the tongue 50 to flex directly proportional to its material properties, the force applied and the location of the force, according to well known beam deflection theory. This deflection will bring the protrusion 56 out of a latched relation with the socket 58 permitting the first wing 12 to fold with respect to the second wing 14 about the connection and pivot 39. The tongue 50 will be made out of the same material as the rest of the hanger 10. The tongue 50 also has the perimeter strip 30 defining its boundary.

When the hanger 10 is brought from the folded position as shown in FIG. 2 into the unfolded position as shown in FIG. 1, protrusion 56 engages the lower end 23 of the hook 25. As the hanger 10 closes, lower end 23 causes tongue 50 to deflect. Once the deflection of tongue 50 is great enough, the protrusion 56 will be permitted access into socket 58. Once the protrusion 56 is within socket 58, the tongue 50, since no deflection forces are acting, will return to its original non-deformed position. This places the protrusion 56 within the socket 58 in a secure fashion. It will require a force to be placed by the user on the tongue 50 to remove the protrusion 56 from the socket 58.

Figure 3A:
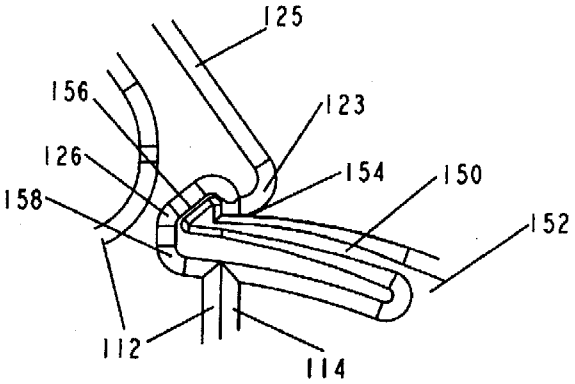
FIG. 3A is a close-up view of the hanger latching means of the second embodiment of the foldable hanger of the instant invention in its closed, latched configuration.
Figure 3:
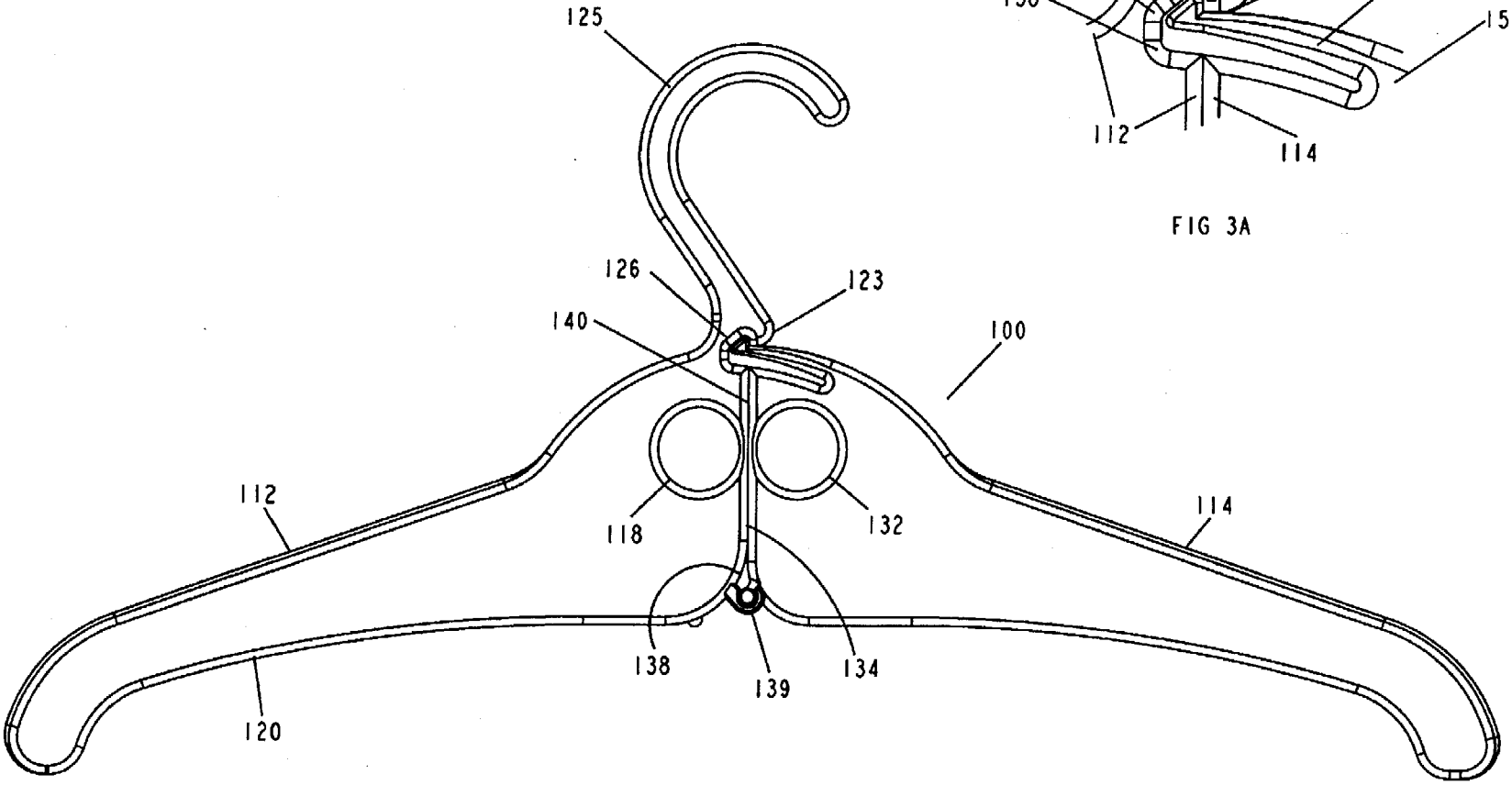
FIG. 3 is a side elevational view of the second embodiment of the foldable hanger of the instant invention in its unfolded, latched configuration.
Figures 4, 4A:
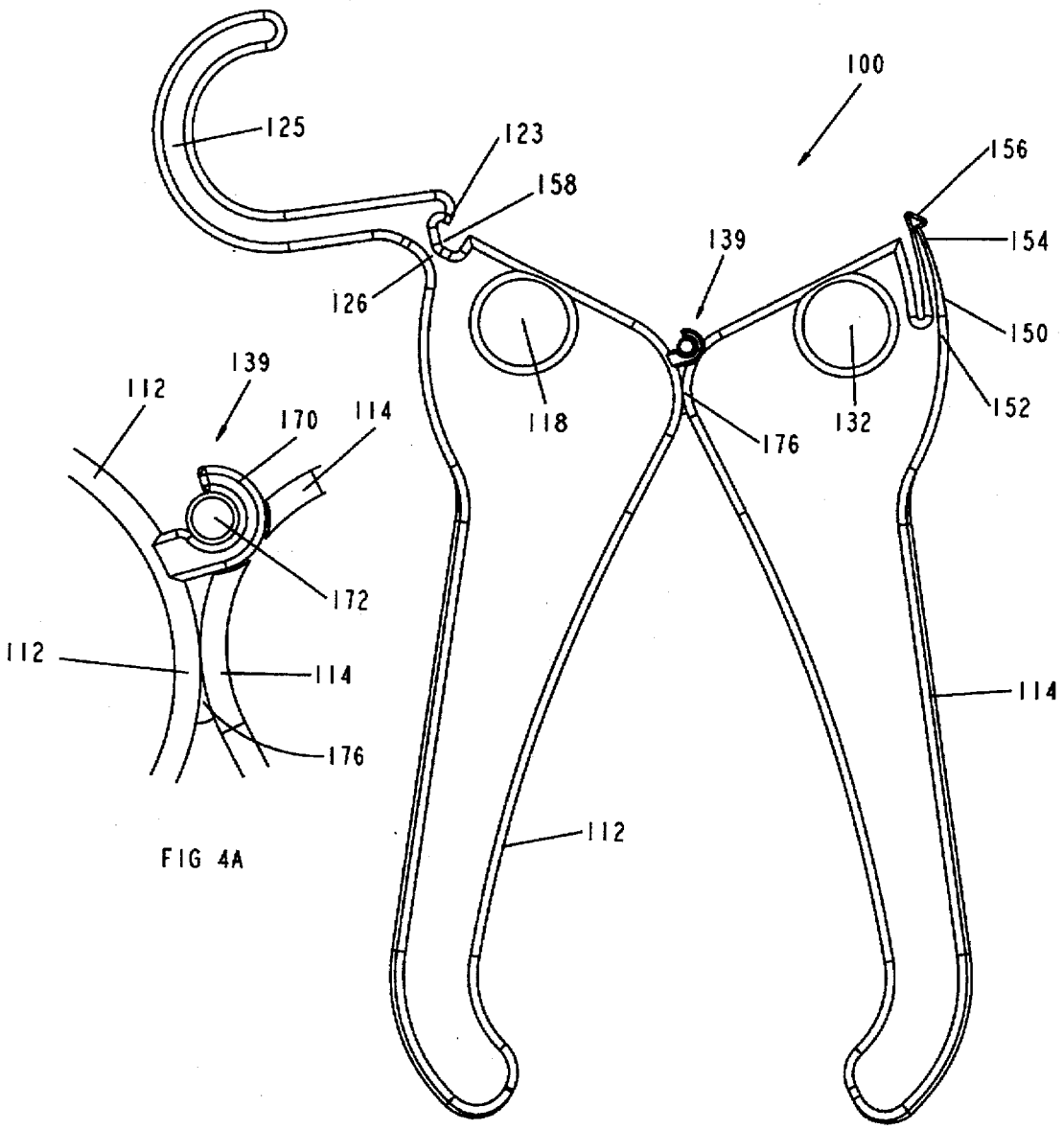
FIG. 4 is a side elevational view of the second embodiment of the foldable hanger of the instant invention in its folded, latched configuration.
FIG. 4A is a close-up view of the connection means of the second embodiment of the invention.

Referring now specifically to FIGS. 3 and 4, the second embodiment of the folding hanger 100 is shown. The folding hanger 100 is comprised of wire and is of unitary construction.

The folding hanger 100 includes a first wing 112 and a second wing 114 which may be placed in a fully open position as shown in FIG. 3 and a folded position as shown in FIG. 4. The first wing 112 and the second wing 114 are symmetric to one another and are substantially the same size. A hook 125 is provided for engagement over a closet bar or the like. The hook 125 is integral with the first wing 112 and is connected thereto by neck 126.

The first wing 112 has a wire 120 which forms the structure of the first wing 112. A first wing finger opening 118 is provided.

The second wing 114 has a wire 130 which forms the structure of the second wing 114. A second wing finger opening 132 is provided.

The vertical separation 134 is a small separation between the first wing 112 and the second wing 114 when the hanger is in the unfolded position as shown in FIG. 3. In the folded position the first wing 112 is substantially flush with the second wing 114. The vertical separation 134 has a lower portion 138 and an upper portion 140. Proximal lower portion 138 is a connection means 139. Connection means 139 connects the first wing 112 to the second wing 114 in such a fashion to permit the articulation or pivoting of the first wing 112 and the second wing 114 from an unfolded position as shown in FIG. 3 and a folded position as shown in FIG. 4. The connection means 139 will permit the first wing 112 to pivot with respect to the second wing 114 and visa versa.

The upper portion 140 includes the latching means. Referring now specifically to FIG. 3A, a close-up view of the latching means is shown. Second wing 114 is shown being latched to first wing 112 by tongue 150. Tongue 150 includes a first end 152 and a second end 154. A protrusion 156 depends from the second end 154. A receiving socket 158 is shown, described by the lower end 123 of the hook 125, the neck 126 and the first wing 112. The socket 158 receives the second end 154 and the protrusion 156 within. When the tongue 150 is so received in the socket 158, the first wing 112 and the second wing 114 are positively secured in the unfolded relationship as shown in FIG. 3.

When tongue 150 is pushed in a downward manner, it acts as a cantilevered beam with the fixed end being the first end 152. This will cause the tongue 150 to flex directly proportional to its material properties, the force applied and the location of the force, according to well known beam deflection theory. This deflection will bring the protrusion 156 out of a latched relation with the socket 158 permitting the first wing 112 to fold with respect to the second wing 114 about the connection and pivot 139. The tongue 150 will be made out of the same wire as the rest of the hanger 100.

When the hanger 100 is brought from the folded position as shown in FIG. 3 into the unfolded position as shown in FIG. 4, protrusion 156 engages the lower end 123 of the hook 125. As the hanger 100 closes, lower end 123 causes tongue 150 to deflect. Once the deflection of tongue 150 is great enough, the protrusion 156 will be permitted access into socket 158. Once the protrusion 156 is within socket 158, the tongue 150, since no deflection forces are acting, will return to its original non-deformed position. This places the protrusion 156 within the socket 158 in a secure fashion. It will require a force to be placed by the user on the tongue 150 to remove the protrusion 156 from the socket 158.

Referring now to FIG. 4A, a close up view of the connection means 139 is shown. The first wing 112 has a generally J-shaped hook 170 depending from the first wing 112 as shown. The second wing 114 has a pin element 172 depending from the second wing 114 as shown. The pin element 172 is retained in the J-shaped hook 170 in a permanent and rotatable fashion. Pin element 172 may rotate within the J-shaped hook 170 which allows the first wing 112 to rotate with respect to the second wing 114 and visa versa. First wing 112 will abut second wing 114 at point 176 when the hanger 100 is in its fully unfolded configuration.

It may be desirable to manufacture a substantially similar device out of wood. Wood hangers are well known and have advantages.

It is apparent from the above that the present invention accomplishes all of the objectives set forth by providing an improved folding hanger with a simple folding and latching mechanism which has an ease of use and manufacture.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A folding hanger for use with garments comprising:

a first wing and a second wing, including a pivot means, said pivot means attached to said first wing and said second wing, said pivot means permitting said first wing and said second wing to articulate between a first unfolded position and a second folded position, and a latching means, said latching means including a spring biased tongue means which is accessible from an outer edge, said tongue means being received in a socket, said tongue means being integral with said first wing and said socket being integral with said second wing, wherein when said hanger is in said first unfolded position, said tongue means is received in said socket, securing said hanger in said first unfolded position, and when said tongue is depressed, said tongue means is brought out of relation with said socket, permitting said hanger to pivot to said second folded position about said pivot means.

2. The folding hanger as claimed in claim 1 wherein said hanger has an upper portion and a lower portion, said latching means being proximal said upper portion and said pivot means proximal said lower portion.

3. The folding hanger as claimed in claim 2 wherein said tongue means has a first end and a second end, said second end including a protrusion, said protrusion being further the portion of said tongue means which is received in said socket.

4. The folding hanger as claimed in claim 3 wherein the first wing includes a first wing finger hole, said first wing finger hole located on said first wing intermediate said upper portion and said lower portion.

5. The folding hanger as claimed in claim 4 wherein the second wing includes a second wing finger hole, said second wing finger hole located on said second wing intermediate said upper portion and said lower portion.

6. The folding hanger as claimed in claim 5 wherein said folding hanger is comprised of molded plastic.

7. The folding hanger as claimed in claim 6 wherein said pivot means includes a living hinge.

8. The folding hanger as claimed in claim 5 wherein said folding hanger is comprised of wire.

9. The folding hanger as claimed in claim 8 wherein said pivot means includes a hook element attached to said first wing.

10. The folding hanger as claimed in claim 9 wherein said pivot means includes a pin element attached to said second wing.

11. The folding hanger as claimed in claim 10 wherein said pin element is received in said hook element in such a manner to permit the pivoting of said first wing with respect to the second wing and visa versa.

12. The folding hanger as claimed in claim 2 wherein said first wing includes a J-hook depending therefrom, said J-hook depending proximal said upper portion, said J-hook designed to engage a hanger rod.

13. A folding hanger for use with garments comprising:

a first wing and a second wing, including a hinge means, said hinge means attached to said first wing and said second wing, said hinge means permitting said first wing and said second wing to articulate between a first unfolded position and a second folded position, and a latching means, said latching means including a spring biased tongue means which is received in a socket, said tongue means being accessible from an outer edge, said tongue means being integral with said first wing and said socket being integral with said second wing, said tongue means further having a first end and a second end, said second end including a protrusion, wherein when said hanger is in said first unfolded position, said second end is received in said socket, securing said hanger in said first unfolded position, and when said tongue means is depressed, said second end is brought out of relation with said socket, permitting said hanger to pivot to said second folded position about said hinge means.

14. A folding hanger as claimed in claim 13 wherein said hinge means includes a living hinge.

15. A folding hanger as claimed in claim 5 wherein the folding hanger is comprised of wood.

* * * * *